US006119896A

United States Patent [19]

Varini

[11] Patent Number: 6,119,896

[45] Date of Patent: Sep. 19, 2000

[54] FLUID DISPENSER DEVICE

[75] Inventor: Otto Varini, Suzzara, Italy

[73] Assignee: Piusi S.p.A., Suzzara, Italy

[21] Appl. No.: 09/219,307

[22] Filed: Dec. 23, 1998

[30] Foreign Application Priority Data

Jan. 19, 1998 [IT] Italy ..... MO98A0009

[51] Int. Cl.[7] ..... B67D 5/00

[52] U.S. Cl. ..... 222/17; 222/71

[58] Field of Search ..... 222/14, 17, 23, 222/55, 63, 71

[56] References Cited

U.S. PATENT DOCUMENTS 2,955,725 10/1960 Niederst ..... 222/17

3,260,409 7/1966 Benham, Jr. ..... 222/23

4,572,255 2/1986 Rabinovich ..... 222/14

5,257,720 11/1993 Wulc et al. ..... 222/71

*Primary Examiner*—J. Casimer Jacyna

*Attorney, Agent, or Firm*—Browdy And Neimark

[57] ABSTRACT

The command device for dispensing fluids comprises a handgrip posteriorly constrained to a fluid feed pipe and anteriorly bearing a spout connected to the feed pipe and destined to be introduced into an access mouth of a container to be filled with the fluid. A trigger can selectively assume at least a first, closed position in which a connection between the spout and the fluid supply pipe is closed, and a second, open position in which the connection is opened. A mobile lock can on command assume at least a first, locking position, in which the trigger is maintained in the open position, and at least a second unlocked position in which the trigger is free to return into the closed position.

8 Claims, 3 Drawing Sheets

6
51
50
III
III
5
2
3
4
1

FLUID DISPENSER DEVICE

BACKGROUND OF THE INVENTION

The fluid dispenser command device of the invention can be usefully employed for distributing fuels, lubricating oils and other workshop fluids, especially for automobiles. A typical application example is indeed in a car repair and maintenance workshop, where lubricating oil and other fluids are stored in quite large centralized tank units rather than in cans or other relatively small containers.

The centralized units in the prior art are generally one or more storage tanks, equipped with one or more electric pumps which supply the pressurized fluids to one or more hand-held guns through one or more feed pipes. The feed pipes comprise tubes which are normally maintained under pressure by a feed pump, which latter disconnects automatically when a predetermined pressure value (Pmax) is reached. Each gun is equipped with a trigger for manual activation by an operator, who thus controls exit of the pressurized fluid and, in consequence a drop in pressure inside the pipe. When the pressure reaches a minimum threshold level (Pmin) the pump automatically starts up to ensure fluid supply to the gun, and continues in operation until the operator releases the trigger.

The prior art teaches dispenser guns including a trigger lock to hold the trigger open during operation and free the operator's finger. Prior-art guns also include a command device which automatically stops fluid distribution when the fluid volume already dispensed reaches a pre-set quantity. In this case the fluid delivery quantity is set before the gun is operated, and the trigger is locked in the open position, so that it can be safely left to do its work and will stop automatically once the pre-set quantity has been dispensed.

A gun of this type, however, has a serious drawback. If by mistake the trigger should be locked open and left to work without having first preset a desired quantity of fluid to be dispensed, there is the great possibility of considerable spillage. In short, then, the presence of an operator is still required with prior-art dispenser guns.

SUMMARY OF THE INVENTION

The main aim of the present invention is to obviate the above-mentioned drawback by providing a dispenser device which is able to work automatically, stopping when a preset volume of fluid has been distributed, while avoiding spillage due to operator error.

An advantage of the present invention is its high functional reliability. A further advantage is the great operational simplicity of the invention. A further advantage is that the invention is simple and economical. These aims and advantages are all achieved by the present invention, as it is characterized in the claims that follow.

BRIEF DESCRIPTION OF THE DRAWINGS

Further characteristics and advantages of the present invention will better emerge from the detailed description that follows of a preferred but non-exclusive embodiment of the invention, illustrated purely by way of a non-limiting example in the accompanying figures of the drawings, in which.

DESCRIPTION OF THE PREFERRED EMBODIMENTS

Figure 1:
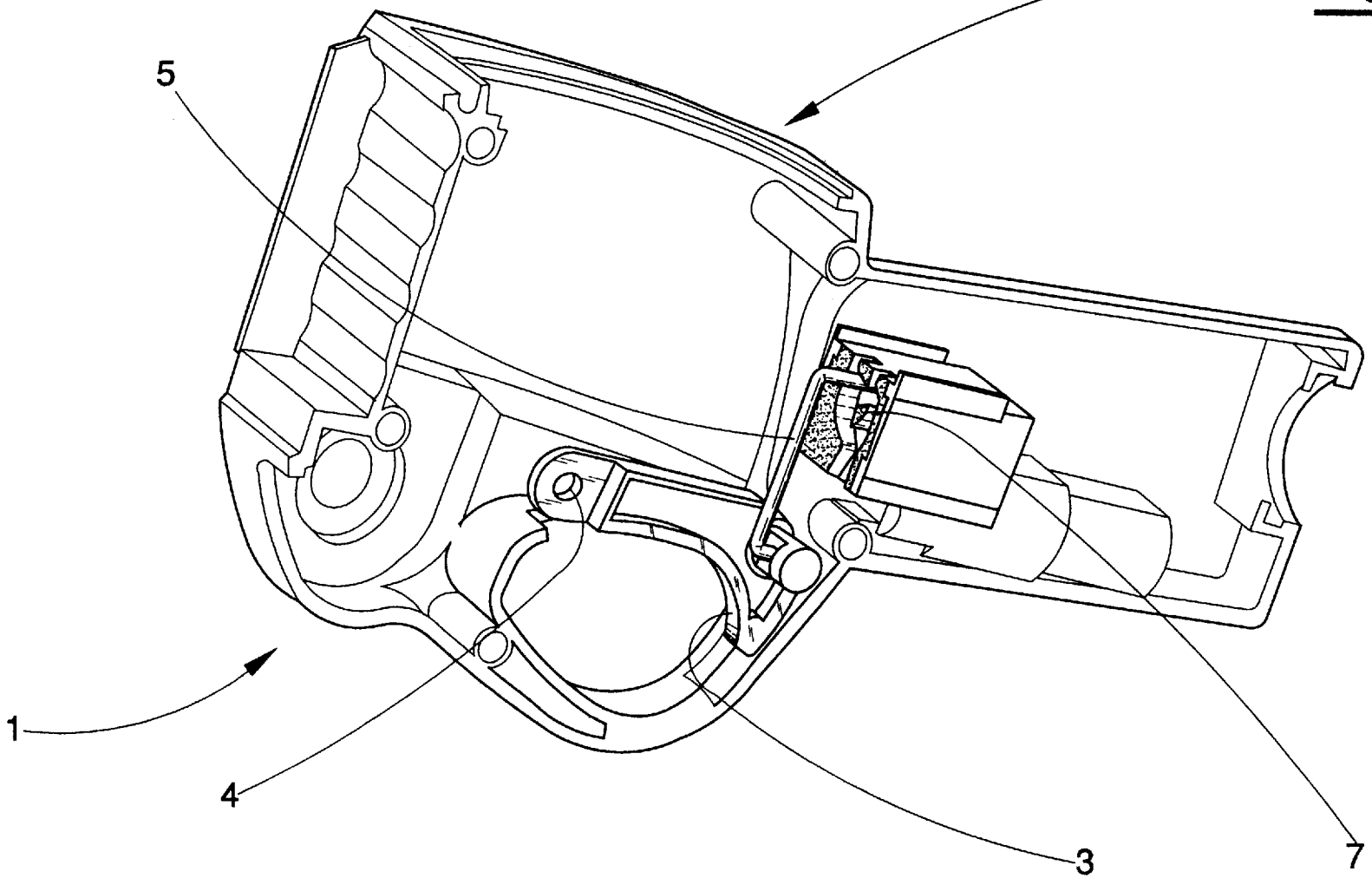
FIG. 1 shows a schematic perspective view of a device according to the invention, with some parts removed better to evidence others.

With reference to the drawings, 1 denotes in its entirety a command device for fluid dispensing. The fluid might be a fuel or a lubricating oil or other fluids of the type usually found in automobile workshops. In the illustrated example the dispenser is a gun-type device, manually-activated and connected by a fixed line to a storage tank or reservoir of known type and not illustrated. A fluid dispensing measuring device (also of known type and therefore not illustrated) is connected to the device, which measures a quantity of dispensed fluid.

The device 1 comprises a grip 2 posteriorly constrained to a fluid supply pipe and anteriorly bearing a spout connected to the supply pipe and destined to be introduced in an access sleeve of a container to be filled with the fluid. The grip comprises a manually-operated trigger 3 which can selectively assume at least a first closed position (lower position) in which the connection between the spout and the pipe is closed, and at least one open position (upper position) in which the above-cited connection is open. The trigger 3, which is pivoted rotatably about a pivot 4, can be moved into the upper open position by means of an upwards pressure. Means are provided for automatically moving and maintaining the trigger 3 in the closed position on release of the lever. The above-mentioned means are of known type and preferably elastic, and might comprise a spring applied on the pivot 4 of the trigger 3.

The device 1 comprises an intermediate element 5, which in the example is represented by a metal U-rod having a first, lower end 50 connected to the trigger 3, for example in a hinge-type coupling, and a second, upper end 51, opposite to the first end, which when the trigger 3 is operated moves from the closed position into the open position, and back to the closed position. Preferably the movement of the upper end 51 follows a forced closed pathway, guided by a plurality of inclined surfaces against which said upper end 51 drags. This forced pathway will be better explained herein below.

Figure 2:
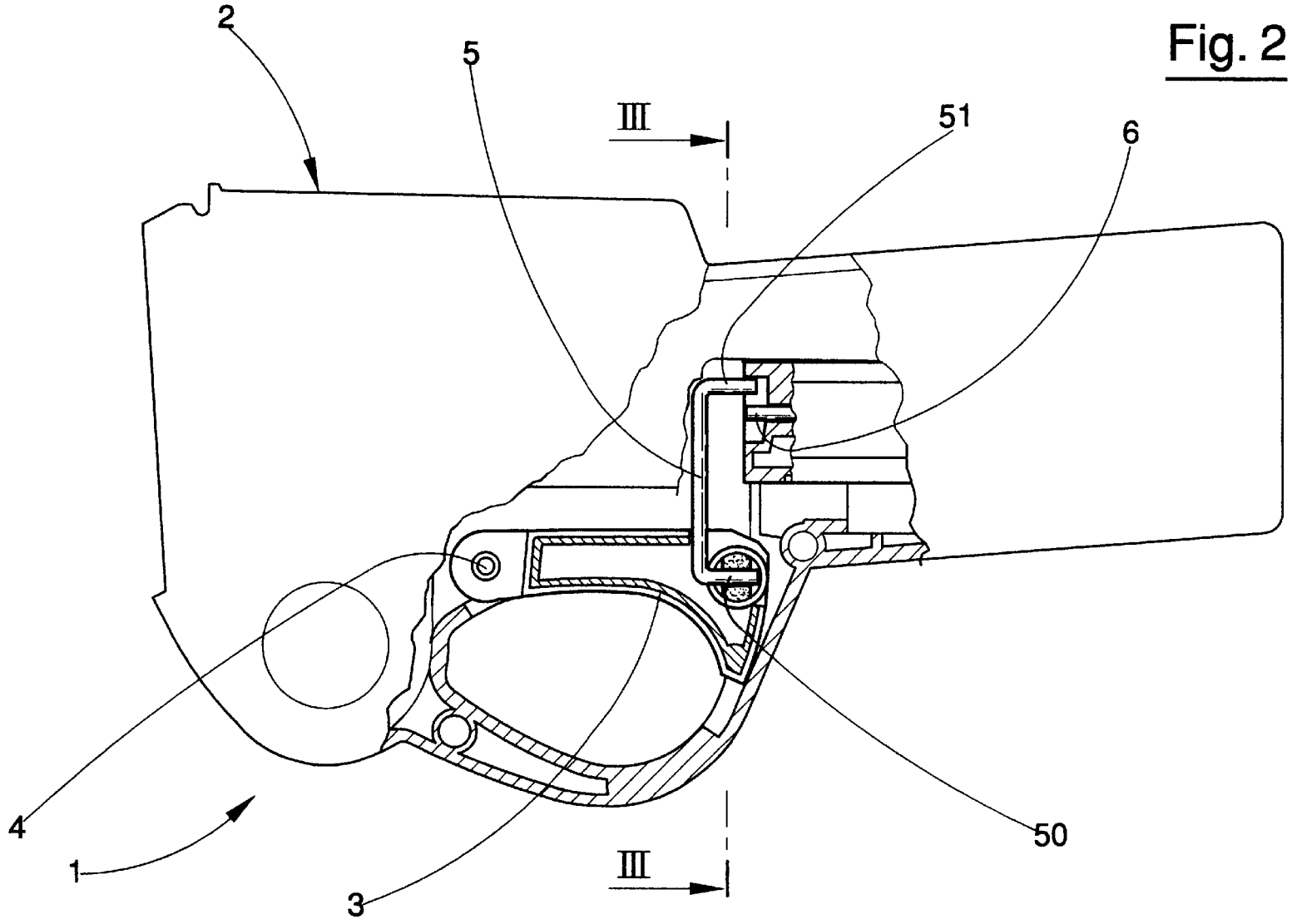
FIG. 2 is a schematic section of the device of FIG. 1.

The device 1 is provided with at least one mobile organ, in effect a lock 6, which on command can assume at least a first position in which it holds the trigger 3 in an open position, and at least a second position in which the trigger 3 is released and can spring back into the closed position. In the example shown the lock 6 comprises a cylindrical pivot which is axially mobile on command of a motor situated internally of the gun and activated by a control unit connected to the dispenser meter. In FIG. 2 the above-mentioned pivot is shown in the advanced locked position; the retreated unlocked position can be reached by means of an axial movement rightwards (with reference to FIG. 2).

In this case the lock 6 blocks the upper end 51 of the intermediate element at a predetermined point in its movement, so that consequently the trigger 3 stays in a raised and open position at least until the lock 6 is newly retracted.

A fixed striker 7 is located at a point along the movement pathway of the upper end 51. The striker 7 is above the upper end 51 when the trigger 3 is located in the lower, closed position. The striker 7 is inferiorly provided with a first inclined surface 71, which the upper end 51 of the intermediate element is destined to strike by effect of a pressure on the trigger 3 and a consequent raising of the upper end itself 51. A second inclined surface 8 is situated above the first inclined surface 71 and by the side of the striker 7. The upper end 51 of the intermediate element is destined to strike the second inclined surface 8 after the first inclined surface 71, during the raising of the upper end 51. The striker 7 is superiorly provided with a third inclined surface 73 which the upper end 51 of the intermediate element is destined to strike after the second inclined surface 8 following releasing of the trigger 3 and a consequent lowering of the upper end 51. There is a fourth inclined surface 9, below the third inclined surface 73 and by the side of the striker 7, on the opposite side with respect to the second inclined surface 8; the upper end 51 of the intermediate element is destined to strike the fourth inclined surface 9 after the third inclined surface 73 and during the lowering of the upper end 51.

The striker 7 is situated by the side of the lock 6 when the former is in the locking position, and is conformed and arranged in such a way as to work together with the lock 6 in order to prevent the upper end 51 of the intermediate element from moving downwards and to prevent the trigger 3 from displacing into the closed position.

There is also a fifth inclined surface 10, situated above the lock 6 in the locking position, predisposed so that by effect of a raising of the upper end 51 starting from a locked position when it is blocked by the lock 6, the upper end 51 is displaced laterally with respect to the lock 6, freeing the upper end 51 to descend vertically without interfering with the lock 6, so as to enable the trigger 3 to return into the closed position.

By means of a keyboard connected to the control unit, the operator can select a preferred quantity of fluid to be dispensed, after which he introduces the spout of the device into the neck of the container to be filled and raises the trigger 3, causing the fluid to start flowing. In the meantime the control unit brings the lock 6 into the advanced locking position, so that when the trigger 3 is released it stops in the open position, enabling the fluid to flow. The control unit is programmed to move the lock 6 into the advanced position in a case where an operator has selected a predetermined volume of fluid to dispense. If the operator has not preset a volume of fluid to be dispensed, the trigger 3 becomes manually operated and returns into the closed position due to the fact that no obstacle to such is met.

Figure 3:
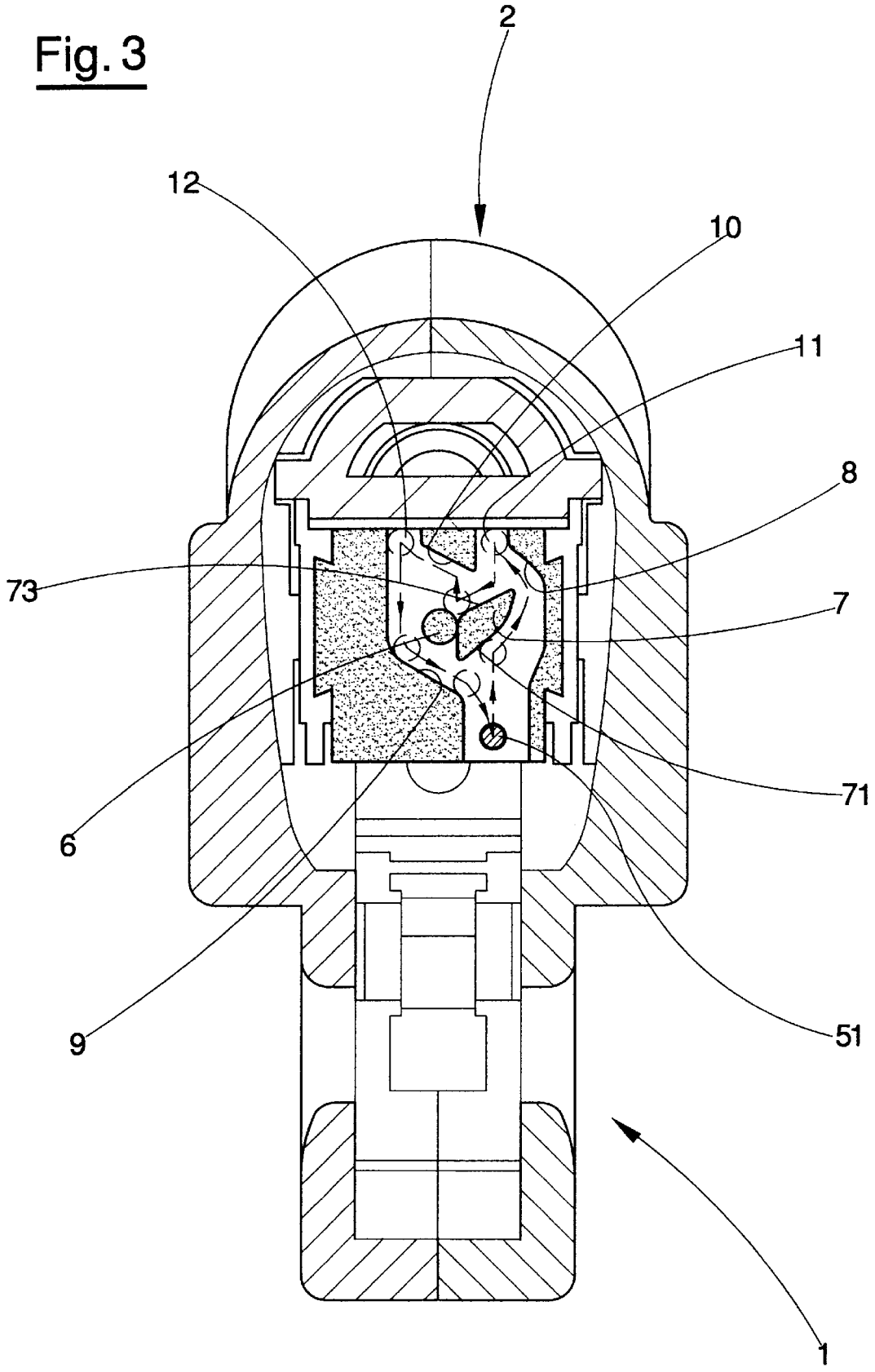
FIG. 3 is a section made according to line III—III of FIG. 2.

FIG. 3 shows, by a series of consecutive arrows, the pathway that the upper end 51 follows in a cycle of opening and closing of the fluid supply. At first, owing to the effect of an upwards pressure on the trigger 3, the upper end 51 is raised up until it strikes the first inclined surface 71, which forces the upper end 51 to deviate laterally rightwards (with reference to FIG. 3). As it continues moving upwards, the upper end 51 strikes against the second inclined surface 8 which forces it to deviate in an opposite direction to the previous direction, i.e. leftwards, up until it reaches a first endrun niche 11 located above the striker 7. Once home in the first niche 11, the upper end 51 cannot make any more movements, whether lateral or upwards. At this point the operator releases the trigger 3, which automatically tends to return to the closed position by effect of the spring. Consequently the upper end 51 descends vertically up until it strikes the third inclined surface 73. The upper end 51 drags along the third inclined surface 73, moving both downwards and leftwards until it strikes the lock 6 in the locking position. The striker 7 and the lock 6 interact to constitute a stop for the upper end 51, which arrests at a point in its pathway when the spout and the fluid supply pipe are in communication and the gun is therefore open. When the volume dispensed by the device 1 has reached the preset quantity, the control unit causes the lock 6 to unlock and the upper end 51 is no longer engaged by the lock 6; the trigger 3 can now descend into the lower closed position, drawing with it the upper end 51 which, during the descent, strikes the fourth inclined surface 9 which causes a rightwards lateral displacement of the upper end 51 and thus terminates the pathway of movement thereof.

When the trigger 3 is locked in the open position, the fluid flow can be stopped at any time by exerting an upwards pressure on the trigger 3. This upwards pressure causes the second end 51, engaged by the lock 6, to move upwards until interacting with the fifth inclined surface 10, which forces the upper end 51 to deviate laterally leftwards until it inserts in a second endrun niche 12 situated by the side of the first niche 11. The subsequent release of the trigger 3 causes the upper end 51 to descend vertically from the second niche 11, without striking the lock 6 and engaging therewith, and reach the lower position, thus closing the dispenser.

After inserting the spout in the container to be filled and locking the trigger 3 in the open position, the operator can leave the device 1 to work without having to worry about spillage, since the control unit 3 keeps the trigger in the open position only if the operator has entered a preferred volume of fluid to be dispensed. In other words, the trigger 3 can be kept in the open position only if its subsequent closure has been pre-programmed.

What is claimed:

1. A command device for fluid dispensing, comprising a grip posteriorly constrained to a fluid supply pipe, and anteriorly bearing a spout connected to the fluid supply pipe and destined to be introduced into an access of a container to be filled with fluid;

the grip having a trigger which can selectively assume at least a first, closed position, in which a connection between the fluid supply pipe and the spout is closed, and a second, open position, in which the connection between the fluid supply pipe and the spout is open;

means for automatically returning the trigger into the closed position and maintaining said trigger there on release thereof, wherein the device comprises at least one mobile lock which can on command assume at least a first position, in which the trigger is locked in the open position, and at least a second position, in which the trigger can move into the closed position; and a U-shaped intermediate element having a lower end which is connected to the trigger and an upper end which is opposite to the lower end and which is acted upon by the lock.

2. The device of claim 1, wherein the lower end of the intermediate element is hinged to the trigger.

3. The device of claim 1, wherein the upper end of the intermediate element is forced to follow a pathway, by effect of a displacement of the trigger, from the closed position to the open position followed by a return into the closed position, the lock being provided to block the upper end at a point in the pathway.

4. The device of claim 3, wherein the pathway followed by said upper end is at least in part a continuous closed circuit.

5. A command device for fluid dispensing, comprising a grip posteriorly constrained to a fluid supply pipe, and anteriorly bearing a spout connected to the fluid supply pipe and destined to be introduced into an access of a container to be filled with fluid;

the grip having a trigger which can selectively assume at least a first, closed position, in which a connection between the fluid supply pipe and the spout is closed, and a second, open position, in which the connection between the fluid supply pipe and the spout is open;

means for automatically returning the trigger into the closed position and maintaining said trigger there on release thereof, wherein the device comprises at least one mobile lock which can on command assume at least a first position, in which the trigger is locked in the open position, and at least a second position, in which the trigger can move into the closed position;

an intermediate element having a lower end which is connected to the trigger and an upper end which is opposite to the lower end and which is acted upon by the lock;

wherein the upper end of the intermediate element is forced to follow a pathway, by effect of a displacement of the trigger, from the closed position to the open position followed by a return into the closed position, the lock being provided to block the upper end at a point in the pathway, wherein the pathway is defined and delimited by a plurality of inclined surfaces on which the upper end of the intermediate element drags.

6. The device of claim 5, comprising a striker which, when the trigger is in the closed position, is situated above the upper end of the intermediate element; said striker being inferiorly provided with a first inclined surface which the upper end is destined to strike by effect of a pressure exerted on the trigger and a consequent raising of the upper end; a second inclined surface being arranged above the first inclined surface and by a side of the striker; the upper end of the intermediate element being destined to strike said second inclined surface after having struck said first inclined surface during a raising of the upper end; said striker being superiorly provided with a third inclined surface which the upper end of the intermediate element is destined to strike after having struck the second inclined surface, following a release of the trigger and a consequent lowering of the upper end; a fourth inclined surface being arranged below the third inclined surface and by a side of the striker and opposite the second inclined surface, the upper end of the intermediate element being destined to strike said fourth inclined surface after having struck the third inclined surface during a lowering of the upper end.

7. The device of claim 6, wherein the striker is situated by a side of the lock during a locking position and is conformed and arranged such as to collaborate with the lock to prevent the upper end of the intermediate element from displacing downwards and returning the trigger towards the closed position.

8. The device of claim 6, comprising a fifth inclined surface, situated above the lock in the locked position and predisposed in such a way that by effect of a raising of the upper end starting from a blocked position in which the upper end is blocked by the lock, the upper end is laterally displaced with respect to the lock, freeing the upper end so that the upper end can descend without interfering with the lock and the trigger can return into the closed position.

* * * * *